US005145503A

United States Patent [19]

Horimura

[11] Patent Number: 5,145,503

[45] Date of Patent: Sep. 8, 1992

[54] PROCESS PRODUCT, AND POWDER FOR PRODUCING HIGH STRENGTH STRUCTURAL MEMBER

[75] Inventor: Hiroyuki Horimura, Saitama, Japan

[73] Assignee: Honda Giken Kogyo Kabushiki Kaisha, Tokyo, Japan

[21] Appl. No.: 708,182

[22] Filed: May 31, 1991

[30] Foreign Application Priority Data

May 31, 1990 [JP] Japan ..... 2-141837
May 31, 1990 [JP] Japan ..... 2-141838

[51] Int. Cl.[5] ..... B22F 1/00

[52] U.S. Cl. ..... 75/228; 75/255; 419/33; 419/48; 419/60; 419/68

[58] Field of Search ..... 75/228, 255; 419/33, 419/48, 60, 68

[56] References Cited

U.S. PATENT DOCUMENTS 4,711,823 12/1987 Shiina ..... 419/29
4,834,941 5/1989 Shiina ..... 419/39
4,867,806 9/1989 Shiina ..... 419/30

*Primary Examiner*—Stephen J. Lechert, Jr.
*Attorney, Agent, or Firm*—Lyon & Lyon

[57] ABSTRACT

In a process for producing a high strength structural member by sintering a starting powder material, a powder mixture of a basic powder and an additional powder is used as the starting powder material. The basic powder is comprised of at least one of an amorphous single-phase alloy powder and at least one kind of a mixed-phase alloy powder which contains a crystalline phase and an amorphous phase and has a crystalline phase volume fraction C (Vf) less than 30%, and the additional powder is comprised of a mixed-phase alloy powder containing a crystalline phase and an amorphous phase and having a crystalline phase volume fraction C (Vf) of at least 30% to less than 80%. The relationship between the minimum volume fraction Pm (Vf) of the additional powder in the starting powder material and the crystalline phase volume fraction C (Vf) in the additional powder is established such that Pm (Vf) = −0.7 C (Vf) + 61. This ensures that a structural member having a high strength and a high toughness can be produced.

13 Claims, 10 Drawing Sheets

PROCESS PRODUCT, AND POWDER FOR PRODUCING HIGH STRENGTH STRUCTURAL MEMBER

BACKGROUND OF THE INVENTION

1. Field of the Invention

The field of the present invention is processes for producing a high strength structural member and particularly, is improvements of processes for producing such a structural member through a sintering (including a molding and a solidification) of a starting powder material.

2. Description of the Prior Art

In a conventional producing process of the type described above, various starting powder materials have been used. When it is intended to provide a further increased strength of a structural member, it is supposed to use, as a starting powder material, an amorphous single-phase alloy powder or a mixed-phase alloy powder containing amorphous phases and crystalline phases.

The reason is that if a thermal hysteresis of at least a crystallization temperature Tx is applied to the alloy powder, a fine crystal structure uniformly appears notwithstanding it is a high alloy, and therefore, increases in strength and toughness can be expected in the above-described structural member.

However, there is a problem that such alloy powder generates a large amount of heat by an exothermic phenomenon when the amorphous phases are crystallized, and it is actually impossible to control the temperature thereof. This tends to bring about a partial coalescence and a non-homogenization of the crystal structure, making it difficult to provide a structural member of the above-described type having an expected strength.

SUMMARY OF THE INVENTION

Accordingly, it is an object of the present invention to provide a producing process of the type described above by which a structural member having a high strength and a high toughness can be produced, thereby solving the above problems.

To achieve the above object, according to a first aspect of the present invention, there is provided a process for producing a high strength structural member by sintering a starting powder material, wherein a powder mixture of a basic powder and an additional powder is used as the starting powder material, the basic powder being comprised of at least one of an amorphous single-phase alloy powder and at least one kind of a mixed-phase alloy powder which contains a crystalline phase and an amorphous phase and has a crystalline phase volume fraction C (Vf) less than 30%, the additional powder being comprised of a mixed-phase alloy powder which contains a crystalline phase and an amorphous phase and has a crystalline phase volume fraction C (Vf) of at least 30% to less than 80%, and a relationship between a minimum volume fraction Pm (Vf) of the additional powder in the starting powder material and the crystalline phase volume fraction C (Vf) in the additional powder being established such that $Pm\ (Vf) = -0.7\ C\ (Vf) + 61$.

In addition, according to a second aspect of the present invention, there is provided a process for producing a high strength structural member by sintering a starting powder material, wherein a powder mixture of a basic powder and an additional powder is used as the starting powder material, the basic powder being comprised of at least one of an amorphous single-phase alloy powder and at least one kind of a mixed-phase alloy powder which contains a crystalline phase and an amorphous phase and has a crystalline phase volume fraction C (Vf) less than 30%, the additional powder being comprised of at least one of a crystalline single-phase alloy powder and a mixed-phase alloy powder which contains a crystalline phase and an amorphous phase and has a crystalline phase volume fraction C (Vf) of at least 80% to less than 100%, a volume fraction P (Vf) of the additional powder in the starting powder material being set such that $5\% \leqq P\ (Vf) \leqq 40\%$.

Further, according to a third aspect of the present invention, there is provided a process for producing a high strength structural member by sintering a starting powder material, wherein a powder mixture of a basic powder and an additional powder is used as the starting powder material, the basic powder being comprised of at least one of an amorphous single-phase alloy powder and at least one kind of a mixed-phase alloy powder which contains a crystalline phase and an amorphous phase and has a crystalline phase volume fraction C (Vf) less than 30%, the additional powder being comprised of a first and a second additional powders, the first additional powder being comprised of a mixed-phase alloy powder containing a crystalline phase and an amorphous phase and having a crystalline phase volume fraction C (Vf) of at least 30% to less than 80%, and the second additional powder being comprised of at least one of a crystalline single-phase allow powder and a mixed-phase alloy powder which contains a crystalline phase and an amorphous phase and has a crystalline phase volume fraction C (Vf) of at least 80% to less than 100%, a volume fraction $P_1$ (Vf) of the first additional powder in the starting powder material being set such that $5\% \leqq P_1\ (Vf) < 40\%$, a volume fraction $P_2$ (Vf) of the second additional powder in the starting powder material being set such that $0\% < P_2\ (Vf) \leqq 3.5\%$, and a relationship between the volume fractions $P_1$ (Vf) and $P_2$ (Vf) of the first and second additional powders and the crystalline phase volume fraction C (Vf) in the first additional powder being established such that $P_1\ (Vf) = [-0.7 + 0.2\ P_2\ (Vf)]\ C\ (Vf) + [61 - 16\ P_2\ (Vf)]$.

If a structural member is produced from a basic powder having a lower volume fraction C (Vf) of amorphous phases or crystalline phases as described above, the structural member has a higher strength, but the dispersion latitude in strength thereof is liable to depart from a range of 10 kg f/mm$^2$. On the other hand, if a structural member is produced from an additional powder having a higher amorphous or crystalline phase volume fraction C (Vf) as described above, the structural member has a lower strength, but the dispersion latitude in strength thereof is substantially fallen within a range of 10 kg f/mm$^2$.

If the above producing process is carried out, with such physical properties in view, using a powder mixture of the basic powder and the particular amount of the additional powder, it is possible to inhibit the increasing of exotherm produced with crystallization of the amorphous phases in the basic powder and the gneration of a chain exothermic phenomenon between the amorphous phases in the basic powder by the additional powder progressed in crystallization and to provide a good moldability of the additional powder, thereby producing a structural member having a fine and uniform crystal structure and having a higher toughness and a higher strength with a dispersion latitude in strength being fallen within a range of 10 kg f/mm$^2$.

However, if the amount of additional powder added departs from such range, the physical amorphous property of the starting powder material is increased, resulting in a difficulty to provide a structural member of the type described above.

The term "crystalline phase volume fraction C (Vf) in the powder" means a volume fraction of a crystalline phase in a single powder particle and so forth.

Still further, according to a fourth aspect of the present invention, there is provided a process for producing a high strength structural member by sintering a starting powder material, wherein a mixed-phase alloy powder is used as the starting powder material, the mixed-phase alloy powder containing an amorphous phase, a crystalline phase and an intermetallic compound phase, with a surface layer of the mixed-phase alloy powder being comprised only of the amorphous and crystalline phases.

With the above fourth feature, it is possible to inhibit the increasing of exotherm produced with crystallization of the amorphous phases in the starting powder material powder and the generation of a chain exothermic phenomenon between the amorphous phases in the basic powder by the intermetallic compound phases and to provide a good moldability and a good bondability of the powder particles due to the absence of the intermetallic compound phase in the surface layer, thereby producing a structural member having a fine and uniform crystal structure and having a higher toughness and a higher strength increased by the dispersion of the intermetallic compound phases.

In this case, the intermetallic compound phase is enclosed by the amorphous phase and the crystalline phase and hence, the coalescence thereof is inhibited. This is further effective if the perimeter of the intermetallic compound phase is the crystalline phase. The crystalline phase volume fraction Vf is preferred to be in a range of 10% to 90%.

Still further, according to a fifth aspect of the present invention, there is provided a process for producing a high strength structural member by sintering a starting powder material, wherein a powder mixture of at most 95% by weight of a primary powder and at least 5% by weight of an additional powder is used as the starting powder material, the primary powder being comprised of at least one of an amorphous single-phase alloy powder and a mixed-phase alloy powder which contains a crystalline phase and an amorphous phase, the additional powder being comprised of a mixed-phase alloy powder containing an amorphous phase, a crystalline phase and an intermetallic compound phase, with a surface layer of the mixed-phase alloy powder of the additional powder being comprised only of the amorphous and crystalline phases.

With the above fifth feature, an action similar to that described above is generated between the primary powder and the additional powder, thereby ensuring that a structural member having a high strength and a high toughness can be produced.

However, if the amount of additional powder added is less than 5% by weight, the moldability of a starting powder material and the bondability of powder particles are degraded, resulting in a reduced strength of a produced structural member.

Still further, according to a sixth aspect of the present invention, there is provided a process for producing a high strength structural member by sintering a starting powder material, wherein a powder mixture of at most 95% of a primary powder and at least 5% by weight of an additional powder is used as the starting powder material, the primary powder being comprised of a mixed-phase alloy powder containing an amorphous phase, a crystalline phase and an intermetallic compound phase which is dispersed in the entire primary powder, the additional powder being comprised of a mixed-phase alloy powder containing an amorphous phase, a crystalline phase and an intermetallic compound phase, with a surface layer of the mixed-phase alloy powder of the additional powder being comprised only of the amorphous and crystalline phases.

With the above sixth feature, an action similar to that described above is generated in the primary powder and/or the additional powder, thereby ensuring that a structural member having a high strength and a high toughness can be produced. The reason why the amount of additional powder added is limited is the same as described above.

The above and other objects, features and advantages of the invention will become apparent from a reading of the following description of the preferred embodiments, taken in conjunction with the accompanying drawings.

BRIEF DESCRIPTION OF THE DRAWINGS

FIGS. 1 to 6 illustrate a first embodiment of the present invention wherein

FIGS. 1(*a*) to 1(*e*) are diagrams illustrating X-ray diffraction patterns for various mixed-phase alloy powders, respectively;

FIGS. 2(*a*) to 2(*c*) are diagrams illustrating differential thermal analysis thermocurves for various mixed-phase alloy powders, respectively;

FIGS. 3(*a*) to 3(*d*) are diagrams for explaining an example of production of a structural member;

FIG. 4 is a graph illustrating a relationship between the crystalline phase volume fraction C (Vf) in a starting powder material and the tensile strength $\sigma_B$ of a resulting structural member;

FIG. 5 is a graph illustrating a relationship between the crystalline phase volume fraction C (Vf) in an additional powder and the minimum volume fraction Pm of the additional powder in the starting powder material;

FIG. 6 is a graph illustrating a relationship between the volume fraction P (Vf) of the additional powder (crystalline volume fraction C (Vf) 80%) in the starting powder material and the tensile strength $\sigma_B$ of the resulting structural member;

FIGS. 7 to 10 illustrate a second embodiment of the present invention, wherein

FIGS. 7(*a*) to 7(*e*) are diagrams illustrating various alloy powders;

FIGS. 8(*a*) to 8(*d*) are diagrams illustrating X-ray diffraction patterns for various alloy powders, similar to FIG. 1;

FIGS. 9(*a*) to 9(*c*) are diagrams illustrating differential thermal analysis thermocurves for various alloy powders, similar to FIG. 2.

DESCRIPTION OF THE PREFERRED EMBODIMENTS

The present invention will now be described by way of a first embodiment in connection with FIGS. 1 to 6.

FIGS. 1(*a*) to 1(*e*) are diagrams illustrating X-ray diffraction patterns for various mixed-phase alloy powders used as a starting powder material. These mixed-phase alloy powders have been produced in a high pressure He gas-atomization process. Each of the mixed-phase alloy powders has a composition of $Al_{8.5}Ni_5Y_8Co_2$ (in which each of numerical values represents an atom %) and is comprised of amorphous phases and crystalline phases.

FIG. 1(*a*) corresponds to the X-ray diffraction pattern for a mixed-phase alloy powder with a crystalline phase volume fraction C (Vf) of 10%; FIG. 1(*b*) corresponds to the X-ray diffraction pattern for a mixed-phase alloy powder with a crystalline phase volume fraction C (Vf) of 20%; FIG. 1(*c*) corresponds to the X-ray diffraction pattern for a mixed-phase alloy powder with a crystalline phase volume fraction C (Vf) of 40%; FIG. 1(*d*) corresponds to the X-ray diffraction pattern for a mixed-phase alloy powder with a crystalline phase volume fraction C (Vf) of 60%; and FIG. 1(*e*) corresponds to the X-ray diffraction pattern for a mixed-phase alloy powder with a crystalline phase volume fraction C (Vf) of 80%.

As apparent from comparison of FIGS. 1(*a*) to 1(*e*), it can be seen that the X-ray diffraction pattern in FIG. 1(*a*) is a wave-form similar to a halo pattern peculiar to an amorphous phase, but the number of peaks is increased with increasing of the crystalline phases.

Figure 1A:
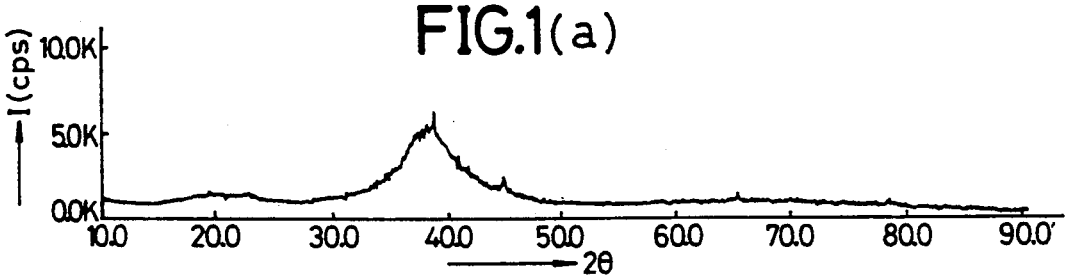
Figure 1B:
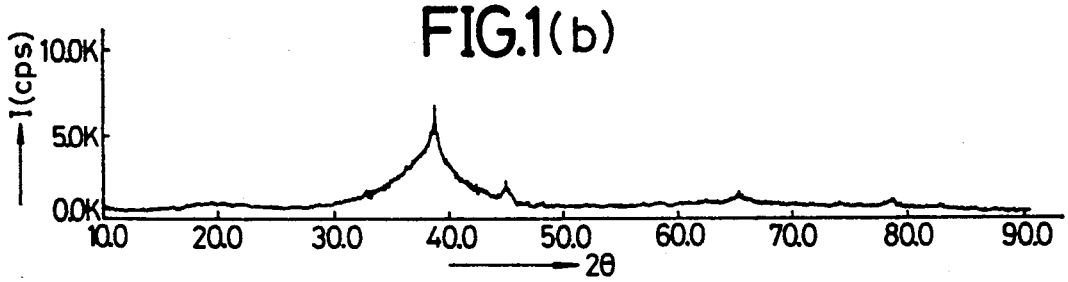
Figure 1C:
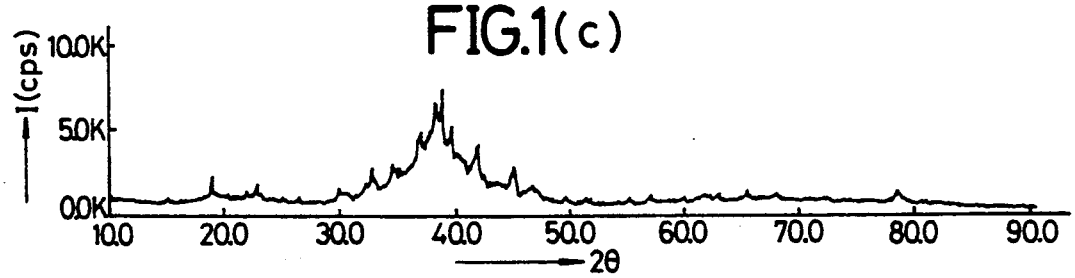
Figure 1D:
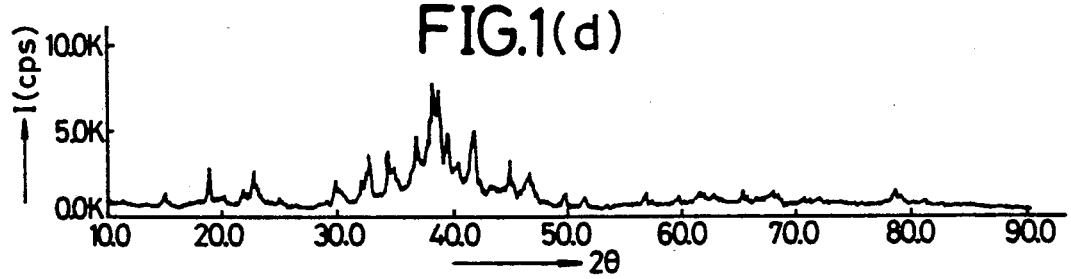
Figure 1E:
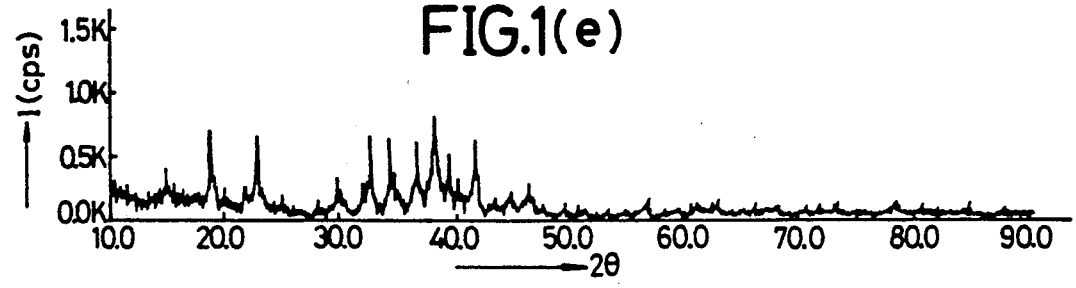
Figure 2A:
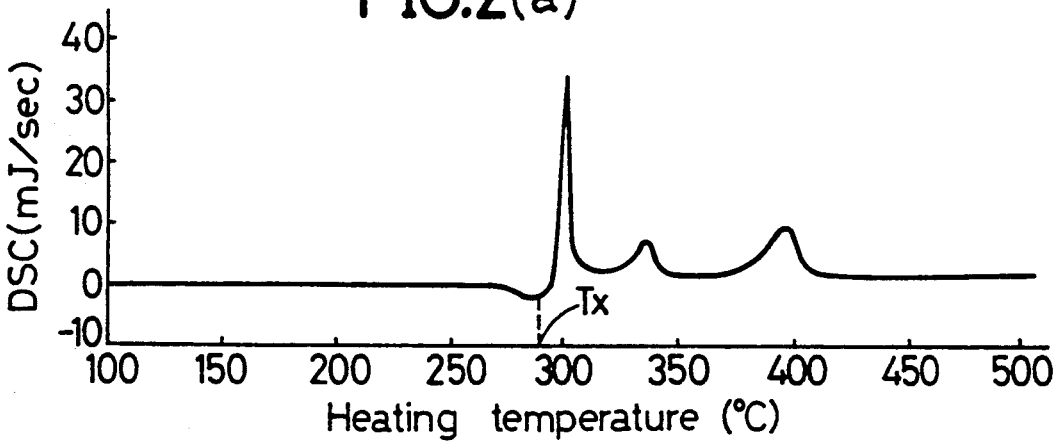
Figure 2B:
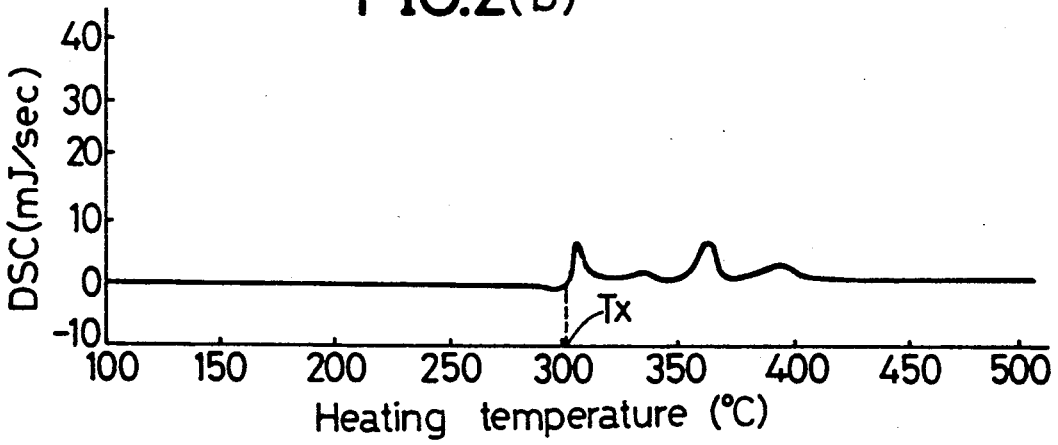
Figure 2C:
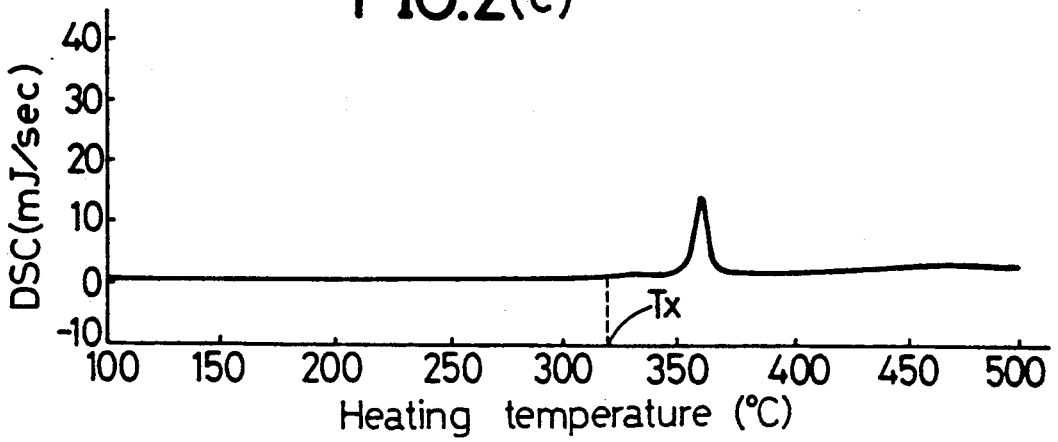
Figure 3A:
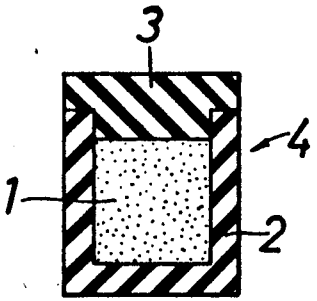
Figure 3B:
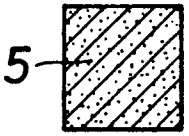
Figure 3C:
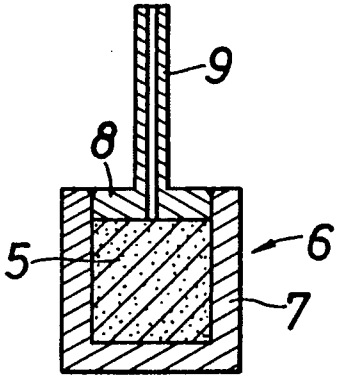
Figure 3D:
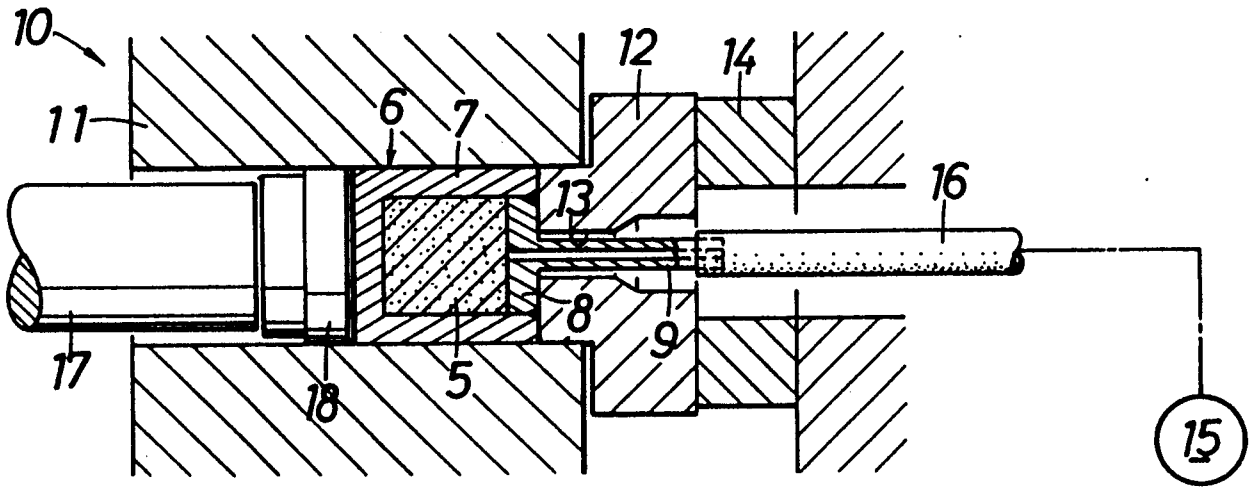

FIGS. 2(*a*) to 2(*c*) are diagrams illustrating differential thermal analysis thermocurves for the above-described mixed-phase alloy powders, wherein FIG. 2(*a*) coresponds to the thermocurve for the alloy powder with a crystalline phase volume fraction C (Vf) of 10%; FIG. 2(*b*) corresponds to the thermocurve for the alloy powder with a crystalline phase volume fraction C (Vf) of 40%; and FIG. 2(*c*) corresponds to the thermocurve for the alloy powder with a crystalline phase volume fraction C (Vf) of 80%.

As apparent from comparison of FIGS. 2(*a*) to 2(*c*), it can be seen that with increasing of the crystalline phases, the crystallization temperature Tx is risen, and the exotherm due to the crystallization of the amorphous phases is reduced. This is because the crystallization of the amorphous phases and the generation of a chain exothermic phenomenon are inhibited by the crystalline phases, and the degree of such inhibition is intensified with increasing of the crystalline phase volume fraction C (Vf). The crystalline temperature Tx is of 299.8° C., 301.4° C., 304.0° C., 310.9° C. and 322.1° C. for the mixed-phase alloy powders having the crystalline phase volume fractions C (Vf) of 10, 20, 40, 60 and 80%, respectively.

It should be noted that the crystalline phase volume fraction C (Vf) in each of the mixed-phase alloy powders has been determined on the basis of a ratio of the peaks in the X-ray diffraction pattern to the exotherm in the differential thermal analysis thermocurve.

Various structural members were produced using an amorphous single-phase alloy powder, various mixed-phase alloy powders and a crystalline single-phase alloy powder each having the above-described composition, alone as a starting powder material.

A process for producing the above structural members is as follows:

(i) As shown in FIG. 3(*a*), a starting powder material 1 is placed into a rubber can 4 comprised of a body 2 and a lid 3, and then subjected to a cold isostatic pressing (CIP) under a condition of a pressure of 4,000 kg f/cm$^2$.

(ii) As shown in FIG. 3(*b*), a short cylindrical columnar green compact 5 having a diameter of 58 mm, a length of 40 mm and a density of 78% is produced as a resut of the cold isostatic pressing.

(iii) As shown in FIG. 3(*c*), the green compact 5 is filled into a can 6 made of aluminum alloy (AA sepecification 6061 material). The can 6 is comprised of a body 7 having an outside diameter of 78 mm and a length of 70 mm and a lid 8 welded into an opening in the body 7. The lid 8 includes a vent pipe 9 permitting the communication between the inside and outside of the body 7.

(iv) As shown in FIG. 3(*d*), the green compact 5 is placed together with can 6 into a container 11 in a single-action type hot extruding machine 10. In this case, the vent pipe 9 extends through a die hole 13 in a die 12 into a die backer 14.

In the hot extruder 10, the maximum pressing force is set at 500 tons; the inside diameter of the container 11 is at 80 mm, and the preheating temperature in the container 11 is at 470° C.

Then, a vacuum pump 15 is connected to the vent pipe 9 through a rubber pipe 16 to depressurize the inside of the can 6. At an instant when the degree of vacuum in the can 6 has become lower than $10^{-5}$ Torr, a stem 17 is advanced to apply a load of about 120 tons to the can 6 through a dummy block 18. This causes the can 6 to be deformed into close contact with the container 11, so that the temperature of the green compact 5 is rapidly risen and reaches 450° C. in about 7 minutes.

A gas contained in the green compact 5 is expelled therefrom by these heating and depressurizing operations, with the result that the degree of vacuum in the can 6 is reduced, but returned to a condition of a degree of vacuum lower than $10^{-5}$ Torr after lapse of about 7 minutes from an instant when the temperature of the green compact 5 reaches 450° C.

The retention time at this temperature varies depending upon the density, composition, structure and the like of the green compact 5 and may be set in a range of 1 minute to 2 hours. In this example of production, when the degree of vacuum in the can 6 has been returned to $10^{-5}$ Torr, the green compact 5 is extruded together with the can 6, so that powder particles are sintered together, thereby providing a round bar-like structural member.

Figure 4:
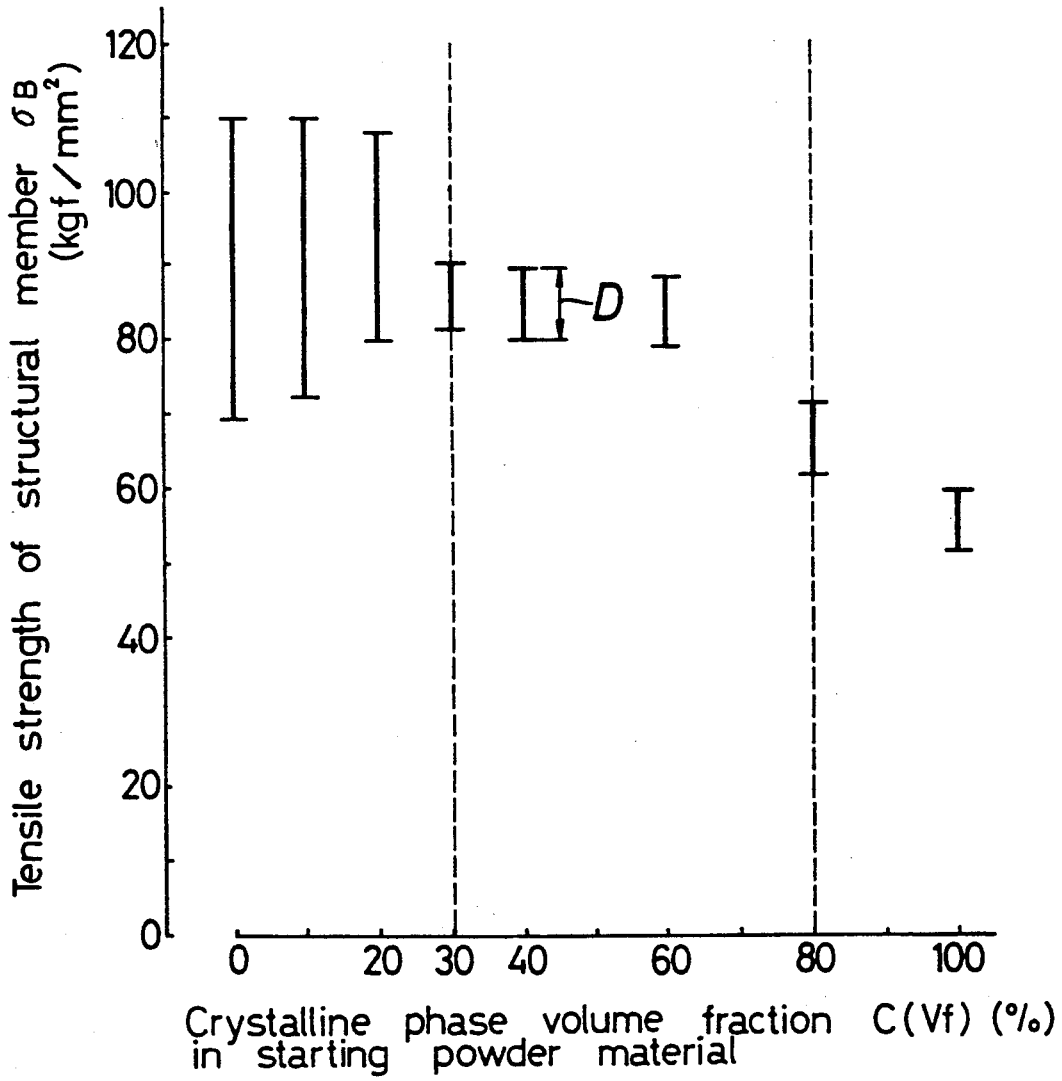

FIG. 4 illustrates a relationship between the tensile strength of the structural member produced in the above process and the crystalline phase volume fraction C (Vf) in the starting powder material. In FIG. 4, D represents a dispersion latitude in strength.

As apparent from FIG. 4, in a range of the crystalline phase volume fractions C (Vf) in the starting powder material of from 30% to 100% with 30% defined as a border, the dispersion latitude D in strength is fallen substantially within a range of 10 kg f/mm$^2$, but in a range of from less than 30% to the amorphous single-phase (the crystalline phase fraction C (Vf)=0%), the dispersion latitude D in strength departs from the range of 10 kg f/mm$^2$.

Taking such physical properties of the starting powder material into consideration, the present invention contemplates the use of a powder mixture consisting of a basic power and an additional powder as a starting powder material, such as those described below.

Blend Example (i)

At least one of an amorphous single-phase alloy powder and at least one kine of a mixed-phase alloy powder containing crystalline phases and amorphous phases and having a crystalline phase volume fraction C (Vf) less than 30% is selected as a basic powder, while a mixed-phase alloy powder containing crystalline phases and amorphous phases and having a crystalline phase volume fraction of at least 30% to less than 80% is selected as an additional powder. The relationship between the minimum volume fraction Pm (Vf) of the additional powder in the starting powder material and the crystalline phase volume fraction C (Vf) in the additional powder is established such that Pm (Vf) = −0.7 C. (Vf) + 61.

Blend Example (ii)

At least one of an amorphous single-phase alloy powder and at least one kine of a mixed-phase alloy powder containing crystalline phases and amorphous phases and having a crystalline phase volume fraction C (Vf) less than 30% is selected as a basic powder, while at least one of a mixed-phase alloy powder containing crystalline phases and amorphous phases and having a crystalline phase volume fraction of C (Vf) of at least 80% to less than 100% and a crystalline single-phase alloy powder is selected as an additional powder. The volume fraction P (Vf) of the additional powder in the starting powder material is set in a range of $5\% \leqq P\ (Vf) \leqq 40\%$.

Blend Example (iii)

At least one of an amorphous single-phase alloy powder and at least one kind of a mixed-phase alloy powder containing crystalline phases and amorphous phases and having a crystalline phase volume fraction C (Vf) less than 30% is selected as a basic powder, while a powder mixture containing a first and a second additional powder is selected as an additional powder. In this case, the first additional powder comprises a mixed-phase alloy powder containing crystalline phases and amorphous phases and having a crystalline phase volume fraction C (Vf) of at least 30% to less than 80%, and the second additional powder comprises at least one of a crystalline single-phase alloy powder and at least one kind of a mixed-phase alloy powder containing crystalline phases and amorphous phases and having a crystalline phase volume fraction C (Vf) of at least 80% to less than 100%. The volume fraction $P_1$ (Vf) of the first additional powder in the starting powder material is set in a range of $5\% \leqq P_1\ (Vf) < 40\%$, and the volume fraction $P_2$ (Vf) of the second additional powder in the starting powder material is preferably set in a range of $0\% < P_2\ (Vf) \leqq 3.5\%$. Further, a relationship between the volume fractions $P_1$ (Vf) and $P_2$ (Vf) of the first and second additional powders and the crystalline phase volume fraction C (Vf) in the first additional powder is established such that $P_1\ (Vf) = [-0.7 + 0.2\ P_2\ (Vf)]\ C\ (Vf) + [61 - 16\ P_2\ (Vf)]$.

In this Blend Example (iii), if the second additional powder volume fraction $P_2$ (Vf) is increased by 1%, the first additional powder volume fraction $P_1$ (Vf) is decreased by 10%. It should be noted that taking the strength of the resulting structural member into consideration, the second additional powder volume fraction $P_2$ (Vf) in the starting powder material may be set to exceed 3.5%; however, the upper limit thereof should be 40%.

Figure 5:
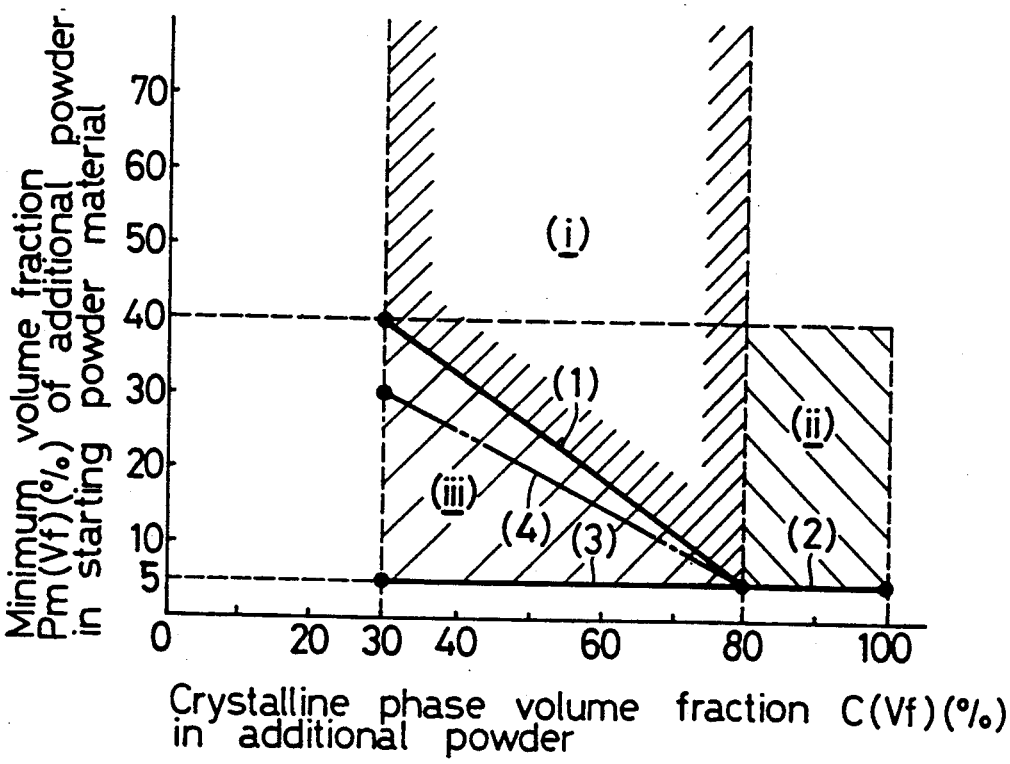

FIG. 5 diagramatically illusrtates the above-described Blend Examples (i) to (iii), wherein lines (1) to (3) correspond to the minimum additional powder volume fractions Pm (Vf) in Blend Examples (i) to (iii), respectively. Therefore, regions indicated by drawing of oblique lines are ranges for Blend Examples (i) to (iii), respectively. In the range for Blend Example (iii), a line (4) given as one example indicates a variation in first additional powder volume fraction $P_1$ when the second additional powder volume fraction $P_2$ (Vf) is set at 1%. Each of the basic powder and the additional powder has the same composition as described above. The basic powder is a mixed-phase alloy powder having a crystalline phase volume fraction C (Vf) of 20%.

If the producing process is carried out using the starting powder materials utilizing Blend Examples (i) to (iii), it is possible to inhibit the increasing of exotherm generated with the crystallization of the amorphous phases in the basic powder and the generation of a chain exothermic phenomenon between the amorphous phases in the basic powder by the additional powder progressed in crystallization and to provide a good moldability of the additional powder, thereby producing a structural member having a fine and uniform crystalline structure and having a high toughness and a high strength with a dispersion latitude fallen within 10 kg f/mm$^2$.

Figure 6:
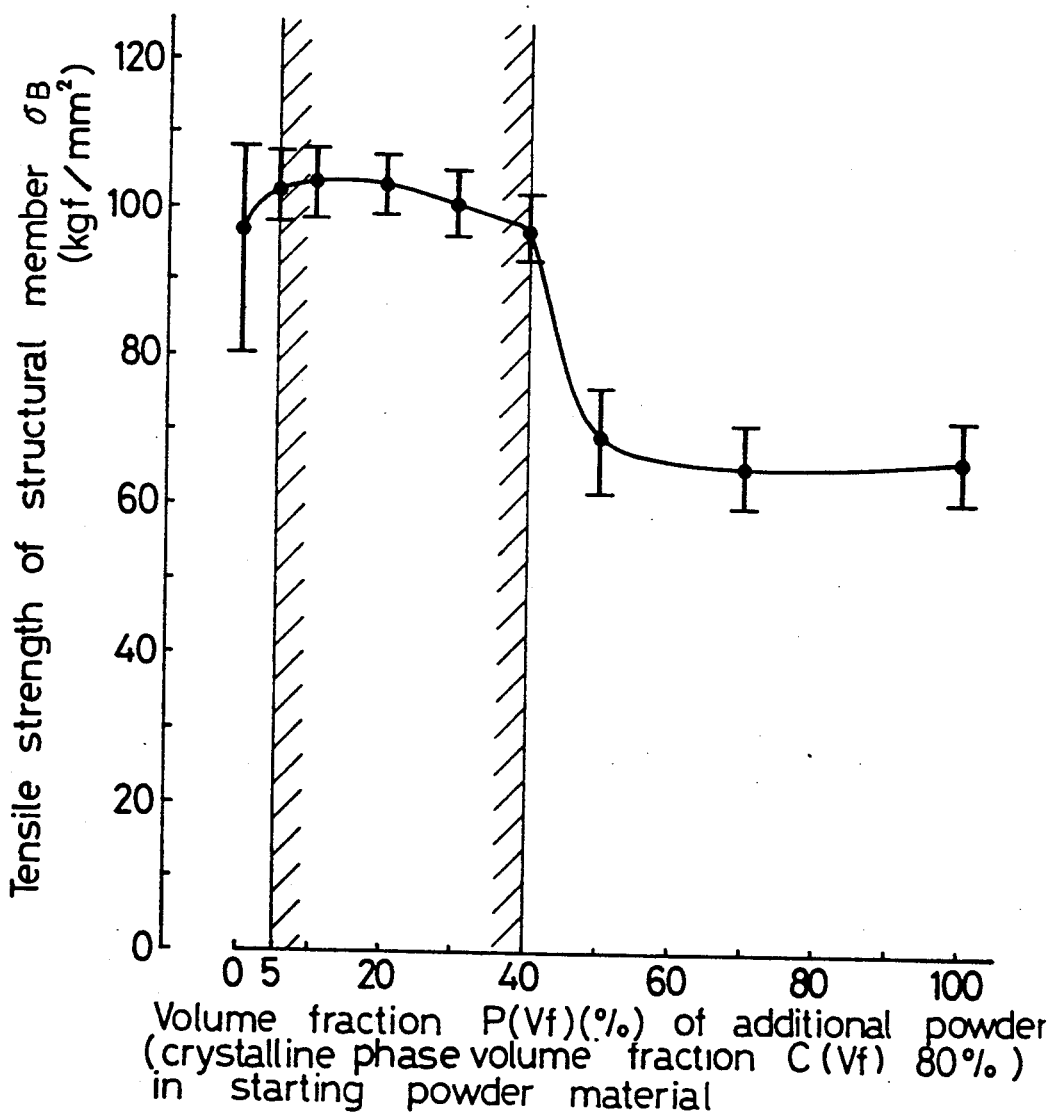
Figure 7A:
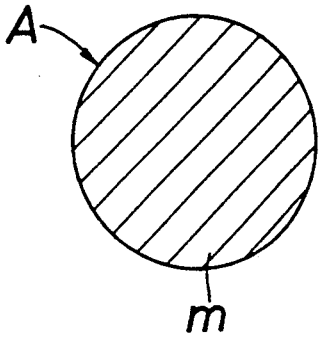
Figure 7B:
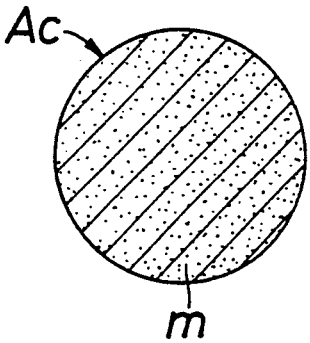
Figure 7C:
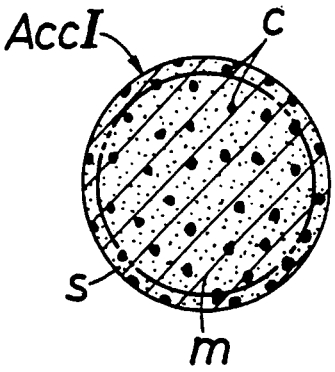
Figure 7D:
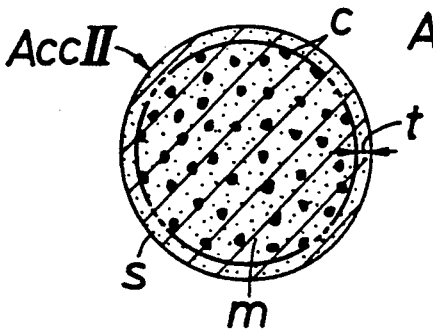
Figure 7E:
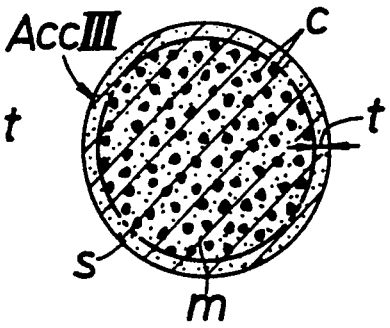
Figure 8A:
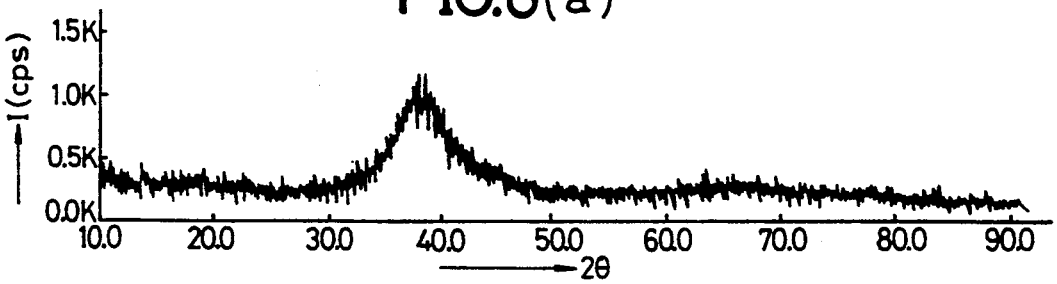
Figure 8B:
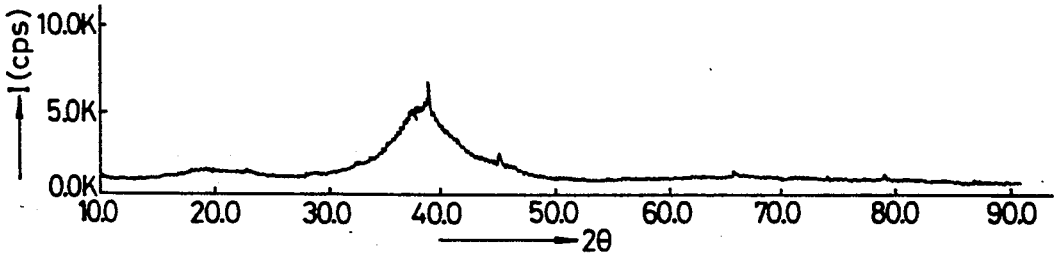
Figure 8C:
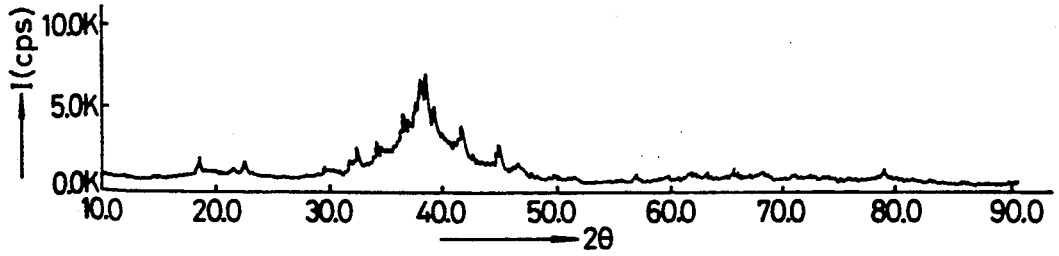
Figure 8D:
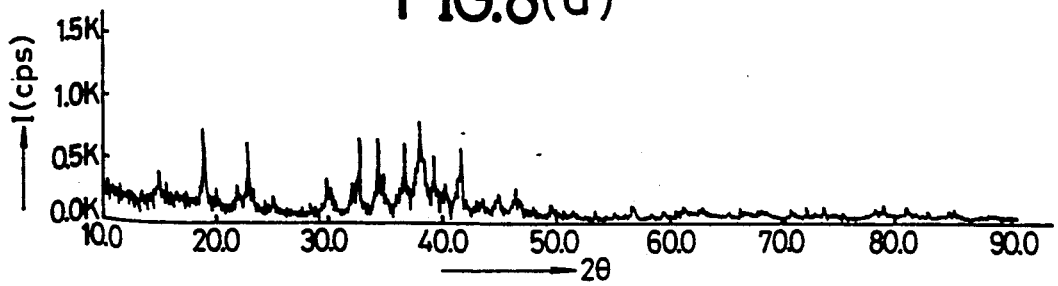

FIG. 6 illustrates a relationship between the tensile strength of a structural member produced by utilizing Blend Example (ii) and the additional powder volume fraction P (Vf) (added amount) in the starting powder material. Each of the basic powder and the additional powder has the same composition as described above. The basic powder is a mixed-phase alloy powder having a crystalline phase volume fraction C (Vf) of 20%, and the additional powder is a mixed-phase alloy powder having a crystalline phase volume fraction C (Vf) of 80%.

As apparent from FIG. 6, it can be seen that if the additional powder volume fraction P (Vf) is set in a range of $5\% \leqq P\ (Vf) \leqq 40\%$, then a high strength structural member is produced, with the dispersion latitude in strength thereof being fallen within 10 kg f/mm$^2$.

Tables I to III show a relationship between Blend Examples (i) to (iii) and the strength of the structural members produced therefrom, respectively. In Tables I to III, each of a numerical value enclosed in a parenthesis represents a crystalline phase volume fraction C (Vf).

TABLE I

[Blend Example (i)]

| Basic powder volume fraction (%) | Additional powder volume fraction P (Vf) (%) | Tensile strength of structural member $\sigma_E$ (kg f/mm$^2$) |
|---|---|---|
| 50 | 50 | 99.1 |
| (20) | (30) | |
| 70 | 30 | 97.8 |
| (20) | (60) | |

TABLE II

| [Blend Example (ii)] | | |
|---|---|---|
| Basic powder volume fraction (%) | Additional powder volume fraction P (Vf) (%) | Tensile strength of structural member $\sigma_E$ (kg f/mm$^2$) |
| 95 (20) | 5 (80) | 106.2 |
| 80 (20) | 20 (80) | 100.5 |
| 60 (20) | 40 (80) | 93.7 |

TABLE III

| [Blend Example (iii)] | | | |
|---|---|---|---|
| Basic powder volume fraction (%) | Add. powder volume fraction (%) | | Tensile strength of structural member $\sigma_E$ (kg f/mm$^2$) |
| | First Add. Po. $P_1$ (Vf) | Second Add. Po. $P_2$ (Vf) | |
| 84 (20) | 14 (50) | 2 (80) | 104.0 |
| 69 (20) | 30 (30) | 1 (80) | 101.1 |

Add. powder volume fraction = Additional powder volume fraction
First Add. Po. = First additional powder
Second Add. Po. = Second additional powder As apparent from Tables I to III, even when any of Blend Example (i) to (iii) is utilized, it is possible to produce a structural member having a strength of at least 90 kg f/mm$^2$.

A second embodiment of the present invention will now be described below. A molten metal of aluminum alloy having a composition of $Al_{85}Ni_5Y_8Co_2$ (in which each of numerical values represents an atom %) was prepared and used to produce an amorphous single-phase alloy powder as shown in FIG. 7(*a*) by application of a high pressure He gas atomization process. A matrix m of the alloy powder A comprises only an amorphous phase.

The amorphous single-phase alloy powder A was subjected to a thermal treatment to produce a mixed-phase alloy powder Ac shown in FIG. 7(*b*). A matrix m of the alloy powder Ac comprises an amorphous phase with a volume fraction Vf of 85% and a crystalline phase with a volume fraction Vf of 15%.

The amorphous single-phase alloy powder A was subjected to a thermal treatment under another condition to produce a mixed-phase alloy powder AccI shown in FIG. 7(*c*). The alloy powder AccI comprises a matrix m and intermetallic compound phases c dispersed in the entire powder. The matrix m comprises an amorphous phase with volume fraction Vf of 60%, a crystalline phase with a volume fraction Vf of 20%, and an intermetallic compound phase c with a volume fraction Vf of 20%. The intermetallic compound phase c comprises an $Al_3Y$ based compound, an Al-Ni-Y based compound or the like and has a high hardness and hence, has a dispersion enhancing capability.

Further, the above-described molten aluminum alloy was used to produce a mixed-phase alloy powder AccII shown in FIG. 7(*d*) by application of a high pressure He gas atomization process under a condition of a cooling rate reduced to a lower level than that in the above-described production. The alloy powder AccII comprises a matrix m and intermetallic compound phases c. The intermetallic compound phases c are dispersed only in the interior of the mixed-phase alloy powder AccII excluding a surface layer s. Therefore, the surface layer s is comprised of only amorphous and crystalline phases. The surface layer s has a thickness of about 0.05 μm. The matrix m comprises an amorphous phase with a volume fraction Vf of 60%, a crystalline phase with a volume fraction Vf of 20%, and an intermetallic compound phase c with a volume fraction Vf of 20%.

Yet further, the above-described molten aluminum alloy was used to produce a mixed-phase alloy powder AccIII shown in FIG. 7(*e*) by application of a high pressure He gas atomization process under a condition of a cooling rate reduced to a further lower level than that in the above-described production. The alloy powder AccIII comprises a matrix m and intermetallic compound phases c. The intermetallic compound phases c are dispersed only in the interior of the mixed-phase alloy powder AccIII excluding a surface layer s. Therefore, the surface layer s comprised of only the amorphous and crystalline phases. The surface layer s likewise has a thickness of about 0.05 μm. The matrix m comprises an amorphous phase with a volume fraction Vf of 20%, a crystalline phase with a volume fraction Vf of 30%, and an intermetallic compound phase c with a volume fraction Vf of 50%.

FIGS. 8(*a*) to 8(*d*) are diagrams illustrating X-ray diffraction patterns for the above-described alloy powders, FIG. 8(*a*) corresponding to the pattern for the mixed-phase alloy powder A; FIG. 8(*b*) corresponding to the patern for the mixed-phase alloy powder Ac; FIG. 8(*c*) corresponding to the pattern for the mixed-phase alloy powders AccI and AccII; and FIG. 8(*d*) corresponding to the pattern for the mixed-phase alloy powder AccIII.

Figure 9A:
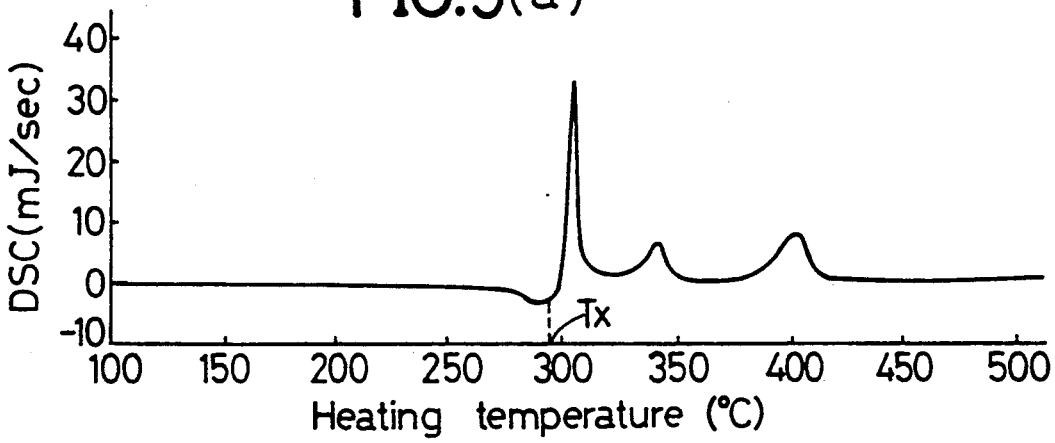
Figure 9B:
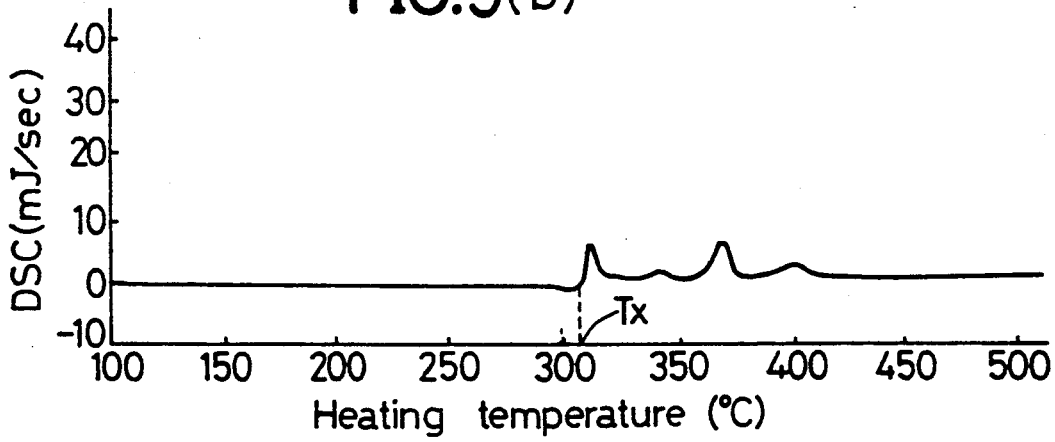
Figure 9C:
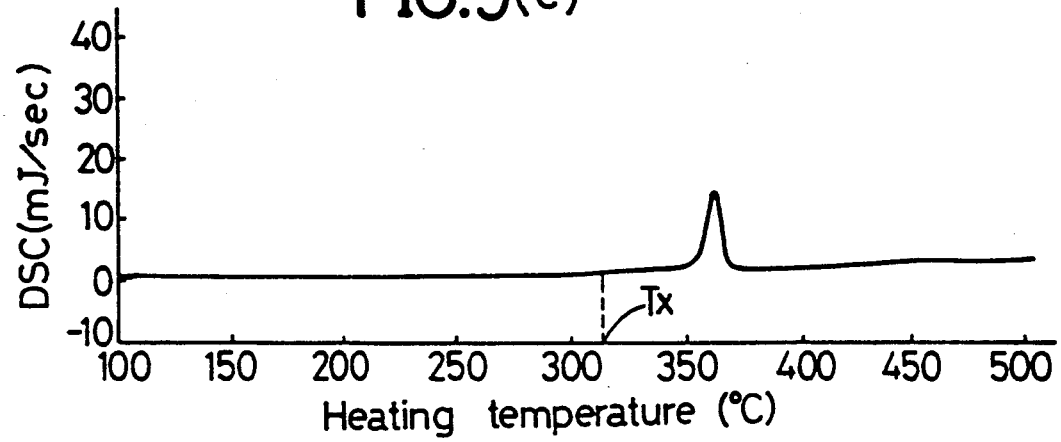

As apparent from comparison of FIGS. 8(*a*) to 8(*d*), it can be seen that a halo pattern peculiar to an amorphous phase is seen in FIG. 8(*a*), but the number of peaks is increased with increasing of the crystalline phases. FIGS. 9(*a*) to 9(*c*) are diagrams illustrating differential thermal analysis thermocurves for the above-described mixed-phase alloy powders, FIG. 9(*a*) corresponding to the thermocurve for the mixed-phase alloy powder Ac; FIG. 9(*b*) corresponding to the thermocurve for the mixed-phase alloy powders AccI and AccII; and FIG. 9(*c*) corresponding to the thermocurve for the mixed-phase alloy powder AccIII.

As apparent from comparison of FIGS. 9(*a*) to 9(*c*), it can be seen that with increasing of the intermetallic compound phases, the crystallization temperature Tx is raised and the exotherm due to the crystallization of the amorphous phases is reduced. This is because the crystallization of the amorphous phases and the generation of a chain exothermic phenomenon are inhibited by the intermetallic compound phases, and the degree of such inhibition is intensified in accordance with increasing of the intermetallic compound phase volume fraction. The crystallization temperature Tx is of 299.8° C., 304.0° C. and 322.1° C. for the mixed-phase alloy powders Ac, AccI (and AccII) and AccIII, respectively.

Then, various structural members were produced using the amorphous single-phase alloy powder A, the mixed-phase alloy powders Ac and AccI to AccIII as a starting powder material.

The process for producing such structural members was carried out in the same manner as in the previously described first embodiment, and will be described in detail.

(i) As shown in FIG. 3(*a*), a starting powder material 1 is placed into a rubber can 4 comprised of a body 2 and lid 3 and then subjected to a cold isostatic pressing (CIP) under a condition of a pressure of 4,000 kg f/cm$^2$.

(ii) As shown in FIG. 3(*b*), a short cylindrical green compact 5 having a diameter of 58 mm, a length of 40 mm and a density of 78% is produced as a result of the cold isostatic pressing.

(iii) As shown in FIG. 3(*c*), the green compact 5 is filled into a can 6 made of aluminum alloy (AA sepecification 6061 material). The can 6 is comprised of a body 7 having an outside diameter of 78 mm and a length of 70 mm, and a lid 8 welded into an opening in the body 7. The lid 8 including a vent pipe 9 permitting the communication between the inside and outside of the body 7.

(iv) As shown in FIG. 3(*d*), the green compact 5 is placed together with the can 6 into a container 11 in a single-action type hot extruding machine 10. In this case, the vent pipe 9 extends through a die hole 13 in a die 12 into a die packer 14.

In the hot extruding machine 10, the maximum pressing force is set at 500 tons; the inside diameter of the container 11 is set at 80 mm; the diameter of the die hole 13 is set at 22 mm; and the preheating temperature in the container 11 is set at 420° C.

Then, a vacuum pump 15 is connected to the vent pipe 9 through a rubber pipe 16 to depressurize the inside of the can 6. At an instant when the degree of vacuum in the can 6 has exceeded $10^{-5}$ Torr, a stem 17 is advanced to apply a load of about 120 tons to the can 6 through a dummy block 18. This causes the can 6 to be deformed into close contact with the container 11, so that the temperature of the green compact 5 is rapidly raised and reaches 400° C. in about 7 minutes.

A gas contained in the green compact 5 is expelled therefrom by this heating and depressurizing action, with the result that the degree of vacuum in the can 6 is reduced, but returned to a condition of a degree of vacuum exceeding $10^{-5}$ Torr after a lapse of about 7 minutes from an instant when the temperature of the green compact 5 has reached 400° C.

The retention time at this temperature varies depending upon the density, composition, structure and the like of the green compact 5 and may be set in a range of 1 minute to 2 hours. In this example of production, when the degree of vacuum in the can 6 has been returned to $10^{-5}$ Torr, the green compact 5 is extruded together with the can 6 at an extrusion temperature of 400° C., so that powder particles are sintered together, thereby providing a round bar-like structural member.

The following Table shows the starting powder material, the extrusion pressure, the tensile strength and the elongation for various structural members I to XIII.

| S.M. No. | Starting powder material (% = % by weight) | Ex. Pre. (kg f/mm$^2$) | T. strength (kg f/mm$^2$) | Elon. (%) |
|---|---|---|---|---|
| I | 100% A | 75.0 | 74.5 | 0 |
| II | 100% Ac | 75.0 | 72.9 | 0 |
| III | 100% AccI | 90.2 | 57.0 | 0 |
| IV | 100% AccII | 76.2 | 95.2 | 2.0 |
| V | 80% A, 20% AccII | 75.5 | 99.5 | 2.0 |
| VI | 50% Ac, 50% AccII | 75.8 | 100.8 | 2.0 |
| VII | 80% Ac, 20% AccII | 74.9 | 101.0 | 2.0 |
| VIII | 90% Ac, 10% AccII | 76.1 | 97.2 | 1.5 |
| IX | 95% Ac, 5% AccII | 75.3 | 90.9 | 1.0 |
| X | 98% Ac, 2% AccII | 74.9 | 72.4 | 0 |
| XI | 80% AccI, 20% AccII | 83.2 | 94.3 | 1.8 |

-continued

| S.M. No. | Starting powder material (% = % by weight) | Ex. Pre. (kg f/mm$^2$) | T. strength (kg f/mm$^2$) | Elon. (%) |
|---|---|---|---|---|
| XII | 100% AccIII | 79.4 | 93.0 | 1.0 |
| XIII | 80% AccII, 20% AccIII | 75.2 | 98.6 | 2.0 |

S.M. No. = Structural member No.
Ex.Pre. = Extrusion pressure
T. strength = Tensile strength
Elon. = Elongation In the above Table, the structural members IV to IX and XI to XIII correspond to those produced according to the present invention.

The structural members IV, XII and XIII are those produced using, as a starting powder material 1, mixed-phase alloy powders AccII, AccIII each containing amorphous phase, crystalline phases and intermetallic compound phases, with a surface layer s consisting of only the amorphous and crystalline phases.

If such a starting powder material 1 is used, it is possible to inhibit the increasing of exotherm generated with the crystallization of the amorphous phases in the starting powder material and the generation of a chain exothermic phenomenon between the amorphous phases in the starting powder material 1 by the intermetallic compound phases c and to provide a good moldability and a good bondability of powder particles due to absence of the intermetallic compound phase c in the surface layer, thereby producing structural members IV, XII and XIII each having a fine and uniform crystalline structure and having a high toughness and a high strength increased by the dispersion of the intermetallic compound phases.

The structural members V to IX have been produced using, as a starting powder material 1, a powder mixture of at least 95% by weight of a primary powder and at least 5% by weight of an additional powder. The primary powder comprises at least one of a mixed-phase alloy powder Ac containing crystalline phases and amorphous phases, and an amorphous single-phase alloy powder, and the additional powder comprises a mixed-phase alloy powder AccII containing amorphous phases, crystalline phases and intermetallic compound phases, with a surface layer s comprised of only the amorphous and crystalline phases. If such a starting powder material 1 is used, an action similar to that described above is produced between the priamry powder and the additional powder, thereby ensuring that structural members V to IX having a high strength and a high toughness can be produced.

However, if the amount of additional powder added is less than 5% by weight, the moldability of the starting powder material 1 is degraded, and the bondability of powder particles is also degraded, resulting in a reduction in strength and elongation of the resulting structural member such as the structural member X.

The structural member XI has been produced using, as a starting powder material 1, a powder mixture of at least 95% by weight of a primary powder and at least 5% by weight of an additional powder. The primary powder comprises at least one of a mixed-phase alloy powder Ac containing amorphous phases, crystalline phases and intermetallic compound phases c dispersed in the entire powder, and the additional powder comprises a mixed-phase alloy powder AccII containing amorphous phases, crystalline phases and intermetallic compound phases, with a surface layer s comprised of only the amorphous and crystalline phases.

If such a starting powder material 1 is used, an action similar to that described above is produced in the priamry powder and/or the additional powder, thereby ensuring that structural member XI having a high strength and a high toughness can be produced.

In the mixed-phase alloy powders AccII and AccIII, the thickness t of the surface layer s is suitable to be at most 0.1 μm. If the thickness t exceeds 0.1 μm, a disadvantage as described above occurs when the amorphous phases of the surface layer s is crystallized.

In the structural members I and II produced using the amorphous single-phase alloy powder A and the mixed-phase alloy powder Ac as a starting powder material 1, a coarse intermetallic compound phase c is observed and is a fracture starting point, resulting in a lower strength.

In the structural member III produced using the mixed-phase alloy powder AccI as a starting powder material 1, intermetallic compound phases c are present even in a surface layer s of the mixed-phase alloy powder AccI and hence, the moldability and the bondability of powder particles are degraded, resulting in a lower strength.

It will be understood that in addition to the hot extrusion, a hot plastic working such as a hot forging may be applied in the present invention.

What is claimed is:

1. A process for producing a high strength structural member by sintering a starting powder material, wherein a powder mixture of a basic powder and an additional powder is used as the starting powder material, said basic powder being comprised of at least one of an amorphous single-phase alloy powder and at least one kind of a mixed-phase alloy powder which contains a crystalline phase and an amorphous phase and has a crystalline phase volume fraction C (Vf) less than 30%, said additional powder being comprised of a mixed-phase alloy powder which contains a crystalline phase and an amorphous phase and has a crystalline phase volume fraction C (Vf) of at least 30% to less than 80%, and a relationship between a minimum volume fraction Pm (Vf) of said additional powder in said starting powder material and the crystalline phase volume fraction C (Vf) in said additional powder being established such that $Pm\ (Vf) = -0.7\ C\ (Vf) + 61$.

2. A process for producing a high strength structural member by sintering a starting powder material, wherein a powder mixture of a basic powder and an additional powder is used as the starting powder material, said basic powder being comprised of at least one of an amorphous single-phase alloy powder and at least one kind of a mixed-phase alloy powder which contains a crystalline phase and an amorphous phase and has a crystalline phase volume fraction C (Vf) less than 30%, said additional powder being comprised of at least one of a crystalline single-phase alloy powder and a mixed-phase alloy powder which contains a crystalline phase and an amorphous phase and has a crystalline phase volume fraction C (Vf) of at least 80% to less than 100%.

a volume fraction P (Vf) of said additional powder in said starting powder material being set such that $5\% \leqq P\ (Vf) \leqq 40\%$.

3. A process for producing a high strength structural member by sintering a starting powder material, wherein a powder mixture of a basic powder and an additional powder is used as the starting powder material, said basic powder being comprised of at least one of an amorphous single-phase alloy powder and at least one kind of a mixed-phase alloy powder which contains a crystalline phase and an amorphous phase and has a crystalline phase volume fraction C (Vf) less than 30%, said additional powder being comprised of a first and a second additional powders, said first additional powder being comprised of a mixed-phase alloy powder containing a crystalline phase and an amorphous phase and having a crystalline phase volume fraction C (Vf) of at least 30% to less than 80%, and said second additional powder being comprised of at least one of a crystalline single-phase alloy powder and a mixed-phase alloy powder which contains a crystalline phase and an amorphous phase and has a crystalline phase volume fraction C (Vf) of at least 80% to less than 100%, a volume fraction $P_1$ (Vf) of said first additional powder in said starting powder material being set such that $5\% \leqq P_1\ (Vf) < 40\%$, a volume fraction $P_2$ (Vf) of said second additional powder in said starting powder material being set such that $0\% < P_2\ (Vf) \leqq 3.5\%$, and a relationship between the volume fractions $P_1$ (Vf) and $P_2$ (Vf) of said first and second additional powders and the crystalline phase volume fraction C (Vf) in said first additional powder being established such that $P_1\ (Vf) = [-0.7 + 0.2\ P_2\ (Vf)]\ C\ (Vf) + [61 - 16\ P_2(Vf)]$.

4. A process for producing a high strength structural member by sintering a starting powder material, wherein a mixed-phase alloy powder is used as the starting powder material, said mixed-phase alloy powder containing an amorphous phase, a crystalline phase and an intermetallic compound phase, with a surface layer of the mixed-phase alloy powder being comprised only of the amorphous and crystalline phases.

5. A process for producing a high strength structural member by sintering a starting powder material, wherein a powder mixture of at most 95% by weight of a primary powder and at least 5% by weight of an additional powder is used as the starting powder material, said primary powder being comprised of at least one of an amorphous single-phase alloy powder and a mixed-phase alloy powder which contains a crystalline phase and an amorphous phase, said additional powder being comprised of a mixed-phase alloy powder containing an amorphous phase, a crystalline phase and an intermetallic compound phase, with a surface layer of the mixed-phase alloy powder of the additional powder being comprised only of the amorphous and crystalline phases.

6. A process for producing a high strength structural member by sintering a starting powder material, wherein a powder mixture of at most 95% of a primary powder and at least 5% by weight of an additional powder is used as the starting powder material, said primary powder being comprised of a mixed-phase alloy powder containing an amorphous phase, a crystalline phase and an intermetallic compound phase which is dispersed in the entire primary powder, said additional powder being comprised of a mixed-phase alloy powder containing an amorphous phase, a crystalline phase and an intermetallic compound phase, with a surface layer of the mixed-phase alloy powder of the additional powder being comprised only of the amorphous and crystalline phases.

7. A high strength structural member produced according to the process of claim 1, 2, 3, 4, 5 or 6.

8. A starting powder material comprising a powder mixture of a basic powder and an additional powder, said basic powder being comprised of at least one of an amorphous single-phase alloy powder and at least one kind of a mixed-phase alloy powder which contains a crystalline phase and an amorphous phase and has a crystalline phase volume fraction C (Vf) less than 30%, said additional powder being comprised of a mixed-phase alloy powder which contains a crystalline phase and an amorphous phase and has a crystalline phase volume fraction C (Vf) of at least 30% to less than 80%, and a relationship between a minimum volume fraction Pm (Vf) of said additional powder in said starting powder material and the crystalline phase volume fraction C (Vf) in said additional powder being established such that $Pm\ (Vf) = -0.7\ C\ (Vf) + 61$.

9. A starting powder material comprising a powder mixture of a basic powder and an additional powder, said basic powder being comprised of at least one of an amorphous single-phase alloy powder and at least one kind of a mixed-phase alloy powder which contains a crystalline phase and an amorphous phase and has a crystalline phase volume fraction C (Vf) less than 30%, said additional powder being comprised of at least one of a crystalline single-phase alloy powder and a mixed-phase alloy powder which contains a crystalline phase and an amorphous phase and has a crystalline phase volume fraction C (Vf) of at least 80% to less than 100%, a volume fraction P (Vf) of said additional powder in said starting powder material being set such that $5\% \leqq P\ (Vf) \leqq 40\%$.

10. A starting powder material comprising a powder mixture of a basic powder and an additional powder, said basic powder being comprised of at least one of an amorphous single-phases alloy powder and at least one kind of a mixed-phase alloy powder which contains a crystalline phase and an amorphous phase and has a crystalline phase volume fraction C (Vf) less than 30%, said additional powder being comprised of a first and a second additional powders, said first additional powder being comprised of a mixed-phase alloy powder containing a crystalline phase an amorphous phase and having a crystalline phase volume fraction C (Vf) of at least 30% to less than 80% and said second additional powder being comprised of at least one of a crystalline single-phase alloy powder and a mixed-phase alloy powder which contains a crystalline phase and an amorphous phase and has a crystalline phase volume fraction C (Vf) of at least 80% to less than 100%, a volume fraction $P_1$, (Vf) of said first additional powder in said starting powder material being set such that $5\% \leqq P_1\ (Vf) < 40\%$, a volume fraction $P_2$ (Vf) of said second additional powder in said starting powder material being set such that $0\% < P_2\ (Vf) \leqq 3.5\%$, and a relationship between the volume fractions $P_1$ (Vf) and $P_2$ (Vf) of said first and second additional powders and the crystalline phase volume fraction C (Vf) in said first additional powder being established such that $P_1\ (Vf) = [-0.7 + 0.2\ P_2\ (Vf)]\ C\ (Vf) + [61 - 16\ P_2\ (Vf)]$.

11. A starting powder material comprising a mixed-phase alloy powder, said mixed-phase alloy powder containing an amorphous phase, a crystalline phase and an intermetallic compound phase, with a surface layer of the mixed-phase alloy powder being comprised only of the amorphous and crystalline phases.

12. A starting powder material comprising a powder mixture of at most 95% by weight of a primary powder and at least 5% by weight of an additional powder, said primary powder being comprised of at least one of an amorphous single-phase alloy powder and a mixed-phase alloy powder which contains a crystalline phase and an amorphous phase, said additional powder being comprised of a mixed-phase alloy powder containing an amorphous phase, a crystalline phase and an intermetallic compound phase, with a surface layer of the mixed-phase alloy powder of the additional powder being comprised only of the amorphous and crystalline phases.

13. A starting powder material comprising a powder mixture of at most 95% of a primary powder and at least 5% by weight of an additional powder, said primary powder being comprised of a mixed-phase alloy powder containing an amorphous phase, a crystalline phase and an intermetallic compound phase which is dispersed in the entire primary powder, said additional powder being comprised of a mixed-phase alloy powder containing an amorphous phase, a crystalline phase and an intermetallic compound phase, with a surface layer of the mixed-phase alloy powder of the additional powder being comprised only of the amorphous and crystalline phases.

* * * * *